US005415434A

United States Patent [19]

Kawashima

[11] Patent Number: 5,415,434

[45] Date of Patent: May 16, 1995

[54] PRINTED MATTER

[76] Inventor: Kiyoharu Kawashima, 5-7, Esaka-cho, 5-chome, Suita-shi, Osaka-fu, Japan

[21] Appl. No.: 179,692

[22] Filed: Jan. 11, 1994

[30] Foreign Application Priority Data

Feb. 12, 1993 [JP] Japan ..... 5-047346

[51] Int. Cl.[6] ..... B42D 15/00

[52] U.S. Cl. ..... 283/95

[58] Field of Search ..... 283/117, 95, 96, 97

[56] References Cited

U.S. PATENT DOCUMENTS

| | | | |
|---|---|---|---|
| 3,638,335 | 2/1972 | Gundensen et al. | 283/95 X |
| 3,682,673 | 8/1972 | Manske | 283/95 X |
| 4,852,912 | 8/1989 | Engel | 283/95 |
| 5,139,572 | 8/1992 | Kawashima | 283/95 X |
| 5,188,871 | 2/1993 | Collings | 283/95 X |
| 5,282,651 | 2/1994 | Alonso | 283/95 X |

FOREIGN PATENT DOCUMENTS

| | | |
|---|---|---|
| 0403903 | 12/1990 | European Pat. Off. . |
| 0460270 | 12/1991 | European Pat. Off. . |
| 0134097 | 12/1989 | Japan . |

*Primary Examiner*—Willmon Fridie

*Attorney, Agent, or Firm*—Birch, Stewart, Kolasch & Birch

[57] ABSTRACT

A printed matter is printed by a ink containing a color coupler that is chromatized from a substantially invisible colorless state to a colored state by means of a color coupling additive applied by an applicator. The color coupler is at least one electron donative coloring compound selected from a group A composed of crystal violet lactone; malachite green lactone; 1.3-dimethyl-6-diethylaminofluoran; 6-diethylamino-benzo[$\alpha$]-fluoran; 3-cyclohexyl methylamino-6-methyl-7-anilinofluoran; benzoyl leucomethylene blue; ethyl leucomethylene blue; methoxybenzoyl leucomethylene blue; 2-(phenylimino ethanedilidene)-3.3-trimethyl-indoline; 1,3.3-trimethyl-indolino-7'-chloro-$\beta$-naphthospiropyran; di-$\beta$-naphthospiropyran; N-acetylauramine; N-phenylauramine; and rhodamine B lactam. The color coupling additive is at least one electron acceptive developing compound selected from a group B composed of zinc salicylate, bisphenol A and inorganic and organic acids.

9 Claims, 1 Drawing Sheet

PRINTED MATTER

BACKGROUND OF THE INVENTION

The present invention relates to a printed matter provided with a color developing area that is changed from a colorless to colored state by application of a color coupling additive, and capable of serving for attractive education and entertainment.

FIELD OF THE INVENTION

It is widely known that such pH-indicators as phenolphthalein, for example, are changed from a substantially invisible colorless state to a visible colored state by an effect of alkali and acid, and a printed matter with such color developing areas as hidden letters and graphics printed by using such pH-indicators as a color coupler has been suggested. Such printed matter is capable of hiding the content of the color developing area from users there and thus keep the users' interest high and provides entertainment to the users. This is done by impressively presenting the content of the printed matter by an apparent color change, such that unexpectedness and the like in the color development of color coupling area from a colorless to colored state occur, and its applications to such fields as picture books, coloring books, reference books and exercise books are demanded.

However, although such pH-indicators are present in various colors, their color coupling pH ranges and achromatic pH ranges are respectively different and specific to them, and it is very difficult to simultaneously chromatize and achromatize multiple pH-indicators with a single color coupling additive. In a printed matter using such pH-indicators, therefore, colors to be developed have been few in number, causing a monotonous appearance, and it was difficult to repeatedly effect the chromatic/achromatic operations in plural colors.

Thus, in consideration of such circumstances, the inventor repeatedly studied various dyes, pigments and the like. As a result, it was found that;

certain electron donative coloring compounds known as dyes react to a specific electron acceptive developing compound, and develop from a colorless to a colored state; and the effect of the developing compound is lost by application of water after the coloration, specifically when zinc salicylate and bisphenol A were employed as developing compound, the coloring compounds returned to the colorless state from the colored state, and the achromatic/chromatic color changes could be effected repeatedly.

It is hence a primary object of the invention to provide a printed matter capable of allowing for a colorful formation of a hidden picture, thereby increasing in appearance, unexpectedness entertaining property. It is a further object to provide such a printed matter wherein the chromatic/achromatic operations can be effected repeatedly.

According to one aspect of the present invention, a printed matter is provided, having in a surface thereof, a color developing area printed by using a ink containing a color coupler that is chromatized from a substantially invisible colorless state to a colored state by means of a color coupling additive applied by an applicator.

The color coupler is at least one electron donative coloring compound selected from a group A composed of crystal violet lactone (blue);
malachite green lactone (green);
1.3 dimethyl-6-diethylaminofluoran (orange);
6-diethylamino-benzo[$\alpha$]-fluoran (red);
3-cyclohexyl methylamino-6-methyl-7-anilinofluoran (black);
benzoyl leucomethylene blue (blue);
ethyl leucomethylene blue (blue);
methoxybenzoyl leucomethylene blue (blue);
2-(phenylimino ethanedilidene)-3.3-trimethyl-indoline (red);
1.3.3-trimethyl-indolino-7'-chloro-$\beta$-naphthospiropyran (purple);
di-$\beta$-naphthospiropyran (purple);
N-acetylauramine (yellow);
N-phenylauramine (yellow); and
rhodamine B lactam (red).

The color coupling additive is at least one electron acceptive developing compound selected from a group B composed of zinc salicylate, bisphenol A and inorganic and organic acids.

An electron donative coloring compound selected from the group A is developed from a colorless state to a colored state specific to the particular coloring compound by coming in molecular contact with an electron acceptive developing compound selected from the group B. Because such a color change is not based on a pH change as in prior art, various coloring compounds can be simultaneously developed to their specific colors by a single color coupling additive, and a colorful hidden picture and the like can be printed. Incidentally, colors after development are shown in parentheses, and three primaries are included in group A, and can be mixed as well for fine printing with complex and diversified tones such as photographs and pictures.

Besides, a printed matter once developed can be immediately achromatized by application of water specifically when zinc salicylate and bisphenol A are employed as the developing compound, then such chromatic/achromatic operations can be effected repeatedly. Therefore, in the case the invention is applied to coloring books, reference books, exercise books and the like, it can be repetitively used, and a product value can be significantly increased.

BRIEF DESCRIPTION OF THE DRAWINGS

An embodiment of the present invention will now be described, by way of example, referring to the attached diagrammatic drawings, in which.

DETAILED DESCRIPTION OF THE INVENTION

Figure 1:
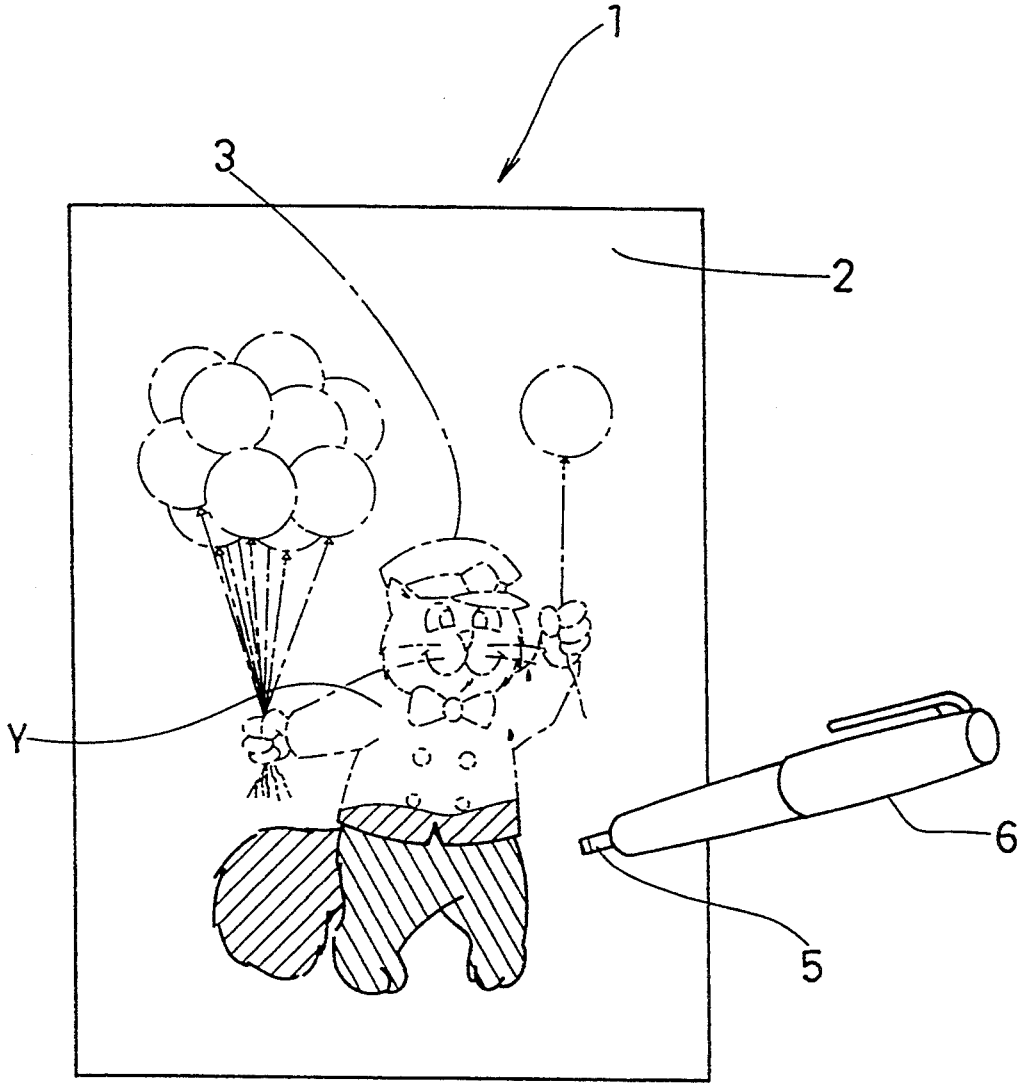
FIG. 1 is a front view showing an embodiment of the invention.

A printed matter 1 has, on a surface of paper 2, a color coupling area Y such as a hidden picture printed by an ink 3 containing a color coupler that is changed from a colorless to a colored state. And the color coupling area Y is developed from a colorless state, and expressed in a colored state by application of a color coupling additive 5 comprising a specified electron acceptive developing compound.

The ink 3 is an anhydrous liquid comprising a color coupler mixed with a vehicle. As a color coupler, one or more compounds selected from the group A composed of crystal violet lactone;
malachite green lactone;
1.3 dimethyl-6-diethylaminofluoran;
6-diethylamino-benzo[α]-fluoran;
3-cyclohexyl methylamino-6-methyl-7-anilinofluoran;
benzoyl leucomethylene blue;
ethyl leucomethylene blue;
methoxybenzoyl leucomethylene blue;
2-(phenylimino ethanedilidene)-3.3-trimethyl-indoline;
1.3.3-trimethyl-indolino-7'-chloro-β-naphthospiropyran;
di-β-naphthospiropyran;
N-acetylauramine;
N-phenylauramine; and
rhodamine B lactam
can be used.

The structure of crystal violet lactone is as follows:

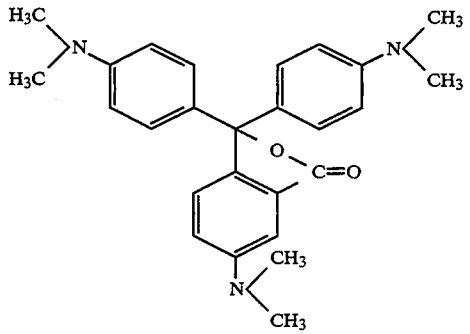

The structure of malachite green lactone is as follows:

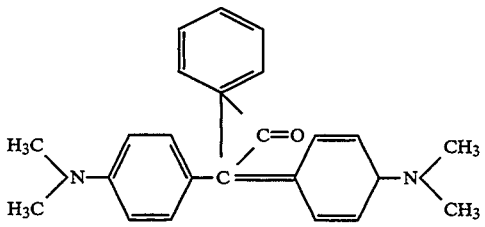

The structure of 1.3 dimethyl-6-diethylaminofluoran is as follows:

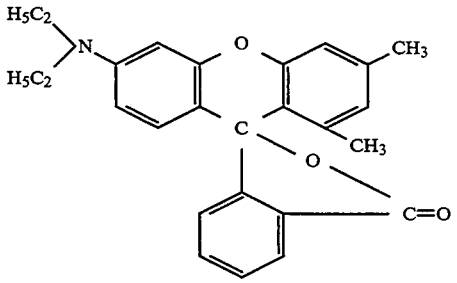

The structure of 6-diethylamino-benzo[α]-fluoran is as follows:

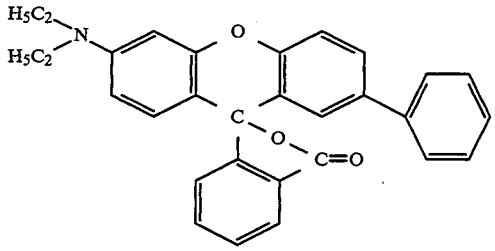

The structure of 3-cyclohexyl methylamino-6-methyl-7-anilinofluoran is as follows:

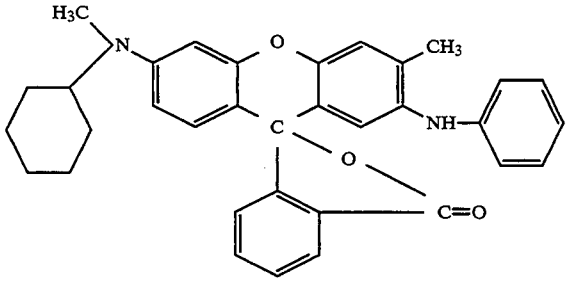

The structure of benzoyl leucomethylene blue is as follows:

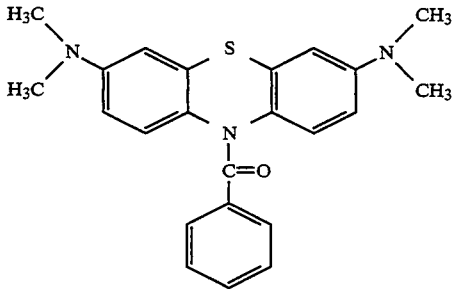

The structure of ethyl leucomethylene blue is as follows:

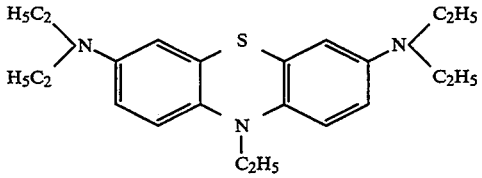

The structure of methoxybenzoyl leucomethylene blue is as follows:

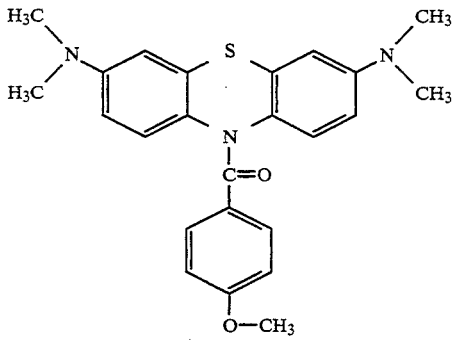

The structure of 2-(phenylimino ethanedilidene)-3.3-trimethyl-indoline is as follows:

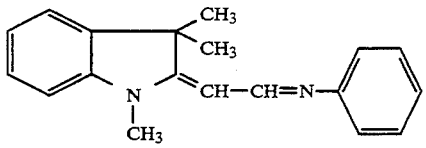

The structure of 1.3.3-trimethyl-indolino-7'-chloro-β-naphthospiropyran is as follows:

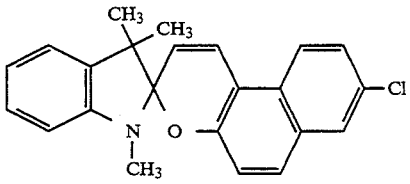

The structure of di-β-naphthospiropyran is as follows:

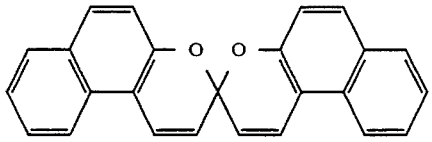

The structure of N-acetylauramine is as follows:

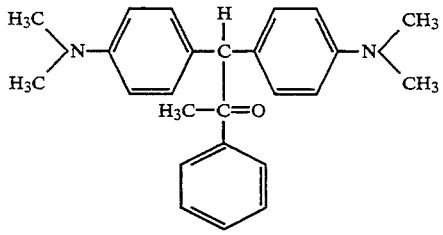

The structure of N-phenylauramine is as follows:

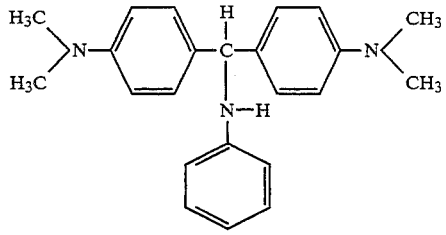

The structure of rhodamine B lactam is as follows:

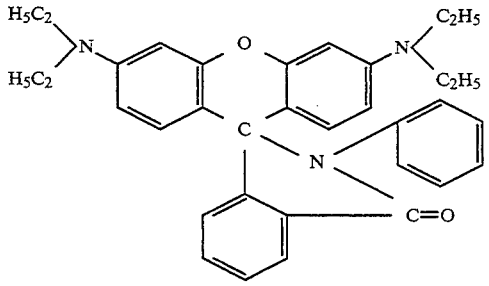

As a vehicle, for example, styrene resin and acrylic resin mixed with a solvent such as dioctyl phthalate and dimethyl phthalate can be employed, and a colorless ink is obtained by agitating the vehicles together with the color coupler for about 20 minutes. Contents and formulation of the vehicles may be varied depending on types of print, and it is preferable to exclude a resin member as a vehicle, and reduce the viscosity for high-speed permeation and drying such as the case of high-speed printing. With the coloring compounds of group A, colors developed can be mixed by combining them, and printing with complex and diversified tones is enabled.

As the color coupling additive 5 for development of the ink 3, there can be employed an electron acceptive developing compound selected from a group B composed of such inorganic acids as hydrochloric acid, nitric acid, acetic acid and sulfuric acid and such organic acids as citric acid, tartaric acid, malic acid and succinic acid in addition to zinc salicylate and bisphenol A.

The structure of zinc salicylate is as follows:

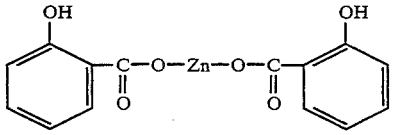

The structure of bisphenol A is as follows:

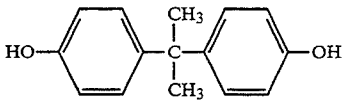

Specifically, out of those in the group B, zinc salicylate and bisphenol A react with the color coupler, and develops the ink 3, while the effect is lost by application of water, and the colored state can be immediately restored to colorless state. In addition, while the achromatized colorless state is maintained even after the water is dried up, by further applying such compound as zinc salicylate, it is changed chromatically, thus, the chromatic/achromatic operations can be repeatedly effected.

Such color coupling additive 5 may be an anhydrous liquid with the electron acceptive developing compound dispersed in a solvent of dimethyl phthalate and ethanol, and such liquid color coupling additive can be applied to the paper 2 by using an applicator 6 such as brush, pen and spray.

Alternatively, the color coupling additive 5 may be formed as a so-called solid crayon with the electron acceptive developing compound milled with carnauba wax, paraffin, haze wax, hardened oil and the like, in such case, the crayon itself forms the applicator 6. When the color coupling additive 5 is applied by such crayon, the paper 2 is coated with the color coupling additive 5 in uneven thickness, forming, in individual artist's touch, irregularities similar to brush streaks, traces of spatula and the like in oil painting, and the printed matter 1 can be expressed in a painting style or the like in conjunction with the complex tones. The color coupling additive 5 may be also formed like an oil paint with the electron acceptive developing compound mixed with such materials as high-viscosity liquid oil and alcohol, in such case, the printed matter 1 can be expressed in a painting style similar to the case of crayon.

Thus, the printed matter 1 of the invention can be used in combination with a solid, in addition to liquid, color coupling additive, and a high educational function can be obtained by using it, for example, in child education and school education, as it provides for learning how to use crayons, pens and paints through development of colors, patterns and the like.

EXAMPLE

By agitating 6 parts by weight of crystal violet lactone, 10 parts by weight of styrene/acrylic resin, 40 parts by weight of dioctyl phthalate and 44 parts by weight of dimethyl phthalate for about 20 minutes by using an agitator, a colorless ink was formed, and a picture, letters and the like were printed with the ink by using a letterpress printing machine.

Additionally, by agitating 3 parts by weight of zinc salicylate, 68 parts by weight of dimethyl phthalate and 29 parts by weight of ethanol for 20 minutes, a liquid color coupling additive was obtained. Then, it was confirmed that the color coupling area printed was chromatized in blue color by applying the color coupling additive to the area, and achromatized swiftly by application of water, and the cycle of (development by color coupling additive)—(achromatic operation by water)—(drying)—(development by color coupling additive) can be effected repeatedly.

What is claimed is:

1. A printed matter having on a surface thereof, a color developing area printed with an anhydrous ink containing a color coupler;

wherein the color coupler can be repeatedly chromatized from a substantially invisible colorless state to a colored state by applying a color coupling additive to said color developing area, wherein the color coupler can be repeatedly achromatized from said colored state to said substantially invisible colorless state by applying a water to said color developing area, and wherein the color coupler is at least one electron donative coloring compound selected from the group consisting of:

crystal violet lactone,
malachite green lactone,
1.3-dimethyl-6-diethylaminofluoran,
6-diethylamino-benzo[$\alpha$]-fluoran,
3-cyclohexyl methylamino-6-methyl-7-anilinofluoran,
benzoyl leucomethylene blue,
ethyl leucomethylene blue,
methoxybenzoyl leucomethylene blue,
2-(phenylimino ethanedilidene)-3.3-triethyl-indoline,
1.3.3-trimethyl-indolino-7'-chloro-$\beta$-naphthospiropyran,
di-$\beta$-naphthospiropyran,
N-acetylauramine,
N-phenylauramine, and
rhodamine B lactam; and wherein the color coupling additive is at least one electron acceptive developing compound selected from the group consisting of zinc salicylate and bisphenol A.

2. A printed matter as recited in claim 1, wherein the color developing area contains more than one of said color couplers.

3. A printing matter as recited in claim 1, wherein the printing matter is a book.

4. A printing system, comprising the following spatially separate components:

at least one color coupling additive which is an electron acceptive developing compound selected from the group consisting of zinc salicylate and bisphenol A; and a printed matter having on a surface thereof, a color developing area printed with an anhydrous ink containing a color coupler;

wherein the color coupler can be repeatedly chromatized from a substantially invisible colorless state to a colored state by applying said color coupling additive to said color developing area, wherein the color coupler can be repeatedly achromatized from said colored state to said substantially invisible colorless state by applying a water to said color developing area, and wherein the color coupler is at least one electron donative color coupling compound selected from the group consisting of:

crystal violet lactone,
malachite green lactone,
1.3-dimethyl-6-diethylaminofluoran,
6-diethylamino-benzo[$\alpha$]-fluoran,
3-cyclohexyl methylamino-6-methyl-7-anilinofluoran,
benzoyl leucomethylene blue,
ethyl leucomethylene blue,
methoxybenzoyl leucomethylene blue,
2-(phenylimino ethanedilidene)-3.3-triethyl-indoline,
1.3.3-trimethyl-indolino-7'-chloro-$\beta$-naphthospiropyran,
di-$\beta$-naphthospiropyran,
N-acetylauramine,
N-phenylauramine, and
rhodamine B lactam.

5. A printing system as recited in claim 4, wherein the color developing area contains more than one of said color couplers.

6. A printing system as recited in claim 4, wherein said system additionally comprises an applicator for applying said color coupling additive to said color developing area.

7. A printing system as recited in claim 6, wherein said applicator is a brush, a crayon, a pen or a sprayer.

8. A method of reversibly chromatizing a printed matter, the method comprising:

providing at least one color coupling additive which is an electron acceptive developing compound selected from the group consisting of zinc salicylate and bisphenol A;

providing a printed matter having on a surface thereof, a color developing area printed with an anhydrous ink containing a color coupler, wherein the color coupler can be repeatedly chromatized from a substantially invisible colorless state to a colored state by applying said color coupling additive to said color developing area, wherein the color coupler can be repeatedly achromatized from said colored state to said substantially invisible colorless state by applying a water to said color developing area, and wherein the color coupler is at least one electron donative color coupling compound selected from the group consisting of:

crystal violet lactone,
malachite green lactone,
1.3-dimethyl-6-diethylaminofluoran,
6-diethylamino-benzo[$\alpha$]-fluoran,
3-cyclohexyl methylamino-6-methyl-7-anilinofluoran,
benzoyl leucomethylene blue,
ethyl leucomethylene blue,
methoxybenzoyl leucomethylene blue,
2-(phenylimino ethanedilidene)-3.3-triethyl-indoline,
1.3.3-trimethyl-indolino-7′-chloro-$\beta$-naphthospiropyran,
di-$\beta$-naphthospiropyran,
N-acetylauramine,
N-phenylauramine, and
rhodamine B lactam;

applying said color coupling additive to said color developing area, to chromatize said color coupler from said substantially invisible colorless state to said colored state; and applying a water to said color developing area, to achromatize said color coupler from said colored state to said substantially invisible colorless state.

9. A method of reversibly chromatizing a printed matter as recited in claim 8, wherein the color developing area contains more than one of said color couplers.

* * * * *